US010815872B2

(12) United States Patent
Nakahara et al.

(10) Patent No.: US 10,815,872 B2
(45) Date of Patent: Oct. 27, 2020

(54) INTAKE PORT STRUCTURE FOR INTERNAL COMBUSTION ENGINE

(71) Applicant: MAZDA MOTOR CORPORATION, Hiroshima (JP)

(72) Inventors: Yasushi Nakahara, Higashihiroshima (JP); Yohei Suzuki, Hiroshima (JP); Tsuyoshi Yamamoto, Hiroshima (JP); Michiharu Kawano, Hiroshima (JP); Yuya Honda, Hiroshima (JP); Kento Onishi, Hiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 0 days.

(21) Appl. No.: 16/478,881

(22) PCT Filed: Mar. 3, 2017

(86) PCT No.: PCT/JP2017/008596

§ 371 (c)(1),
(2) Date: Jul. 18, 2019

(87) PCT Pub. No.: WO2018/158952

PCT Pub. Date: Sep. 7, 2018

(65) Prior Publication Data

US 2019/0383208 A1 Dec. 19, 2019

(51) Int. Cl.
*F02B 31/00* (2006.01)
*F01L 3/22* (2006.01)
(Continued)

(52) U.S. Cl.
CPC ..... *F02B 31/00* (2013.01); *F01L 3/22* (2013.01); *F02F 1/242* (2013.01); *F02F 1/4214* (2013.01);
(Continued)

(58) Field of Classification Search
CPC .... F02B 31/00; F02B 31/04; F02B 2031/006; F02B 2323/108; F02B 23/101;
(Continued)

(56) References Cited

U.S. PATENT DOCUMENTS 5,762,041 A 6/1998 Fraidl et al.
6,109,234 A * 8/2000 Vallance ..... F02B 31/00 123/308
(Continued)

FOREIGN PATENT DOCUMENTS

EP 0 764 773 A2 3/1997
JP H10-131756 A 5/1998
(Continued)

OTHER PUBLICATIONS

International Search Report issued in PCT/JP2017/008596; dated Apr. 18, 2017.

*Primary Examiner* — George C Jin
(74) *Attorney, Agent, or Firm* — Studebaker & Brackett PC

(57) ABSTRACT

In an engine (1), an ignition plug (22) is arranged between a first intake port (6) and a second intake port (7). In a case where a downstream end portion (71) of the second intake port (7) is divided into a first intake port (6) side and an opposite first intake port (6) side, an inner wall surface (71*a*) of an opposite first intake port (6) side portion extends in a direction toward the first intake port (6) as extending from an upstream side to a downstream side of the second intake port (7).

5 Claims, 11 Drawing Sheets

(51) Int. Cl.
*F02F 1/24* (2006.01)
*F02F 1/42* (2006.01)
*F02M 61/14* (2006.01)

(52) U.S. Cl.
CPC ..... *F02F 1/4235* (2013.01); *F02M 61/14* (2013.01); *F02B 2031/006* (2013.01)

(58) Field of Classification Search
CPC ..... F02B 23/10; F02F 1/4235; F02F 1/4214; F02F 1/242; F02F 1/4228; F02M 61/14; F01L 3/22
See application file for complete search history.

(56) References Cited

U.S. PATENT DOCUMENTS

| | | | | |
|---|---|---|---|---|
| 2015/0345420 | A1* | 12/2015 | Han | F02F 1/4228 123/308 |
| 2016/0201551 | A1 | 7/2016 | Uchida et al. | |
| 2019/0226388 | A1* | 7/2019 | Kanno | F02F 1/4235 |

FOREIGN PATENT DOCUMENTS

| | | | |
|---|---|---|---|
| JP | 2004-011614 | A | 1/2004 |
| JP | 2016-128669 | A | 7/2016 |

* cited by examiner

INTAKE PORT STRUCTURE FOR INTERNAL COMBUSTION ENGINE

TECHNICAL FIELD

The technique disclosed herein relates to an intake port structure of an internal combustion engine.

BACKGROUND ART

Patent Document 1 discloses an internal combustion engine including two intake ports for each cylinder. Specifically, in the internal combustion engine according to Patent Document 1, two intake ports are arranged in an engine output axis direction with an ignition plug being interposed therebetween, the ignition plug being arranged in the vicinity of a ceiling surface of a combustion chamber.

CITATION LIST

Patent Document

Patent Document 1: Japanese Unexamined Patent Publication No. 2016-128669

SUMMARY OF THE INVENTION

Technical Problem

However, in a case where the ignition plug is arranged between two intake ports as in Patent Document 1, a distance between the intake ports is increased according to the dimensions of the ignition plug. Thus, particularly in a case where intake air flowing into the combustion chamber through each intake port generates a tumble flow, the intake air separately flows at positions apart in an engine output axis direction. Accordingly, the intensity of turbulence right below an ignition plug portion is relatively weakened, and therefore, there is a probability that ignition performance is degraded.

The technique disclosed herein has been made in view of the above-described point, and an object of the technique is to ensure air-fuel mixture ignition performance when an ignition plug is arranged between two intake ports.

Solution to the Problem

The technique disclosed herein relates to an internal combustion engine intake port structure includes a cylinder forming a combustion chamber, two intake openings opening at a ceiling surface of the combustion chamber and arranged next to each other in an engine output axis direction on one side with respect to an engine output axis when the combustion chamber is viewed in a cylinder axis direction, a first intake port connected to one of the two intake openings, s second intake port connected to the other one of the two intake openings and arranged next to the first intake port in the engine output axis direction, intake valves each provided at the first intake port and the second intake port and configured to open or close the intake openings at substantially identical timing, and an ignition plug arranged to face the inside of the combustion chamber and configured to ignite an air-fuel mixture in the combustion chamber. The ignition plug is arranged between the first intake port and the second intake port.

In a case where a downstream end portion of the second intake port is divided into a first intake port side and an opposite first intake port side in the engine output axis direction, an inner wall surface of a first intake port side portion extends substantially perpendicularly to the engine output axis as extending from an upstream side to a downstream side of the second intake port, and an inner wall surface of an opposite first intake port side portion extends in a direction toward the first intake port as extending from the upstream side to the downstream side of the second intake port.

The "combustion chamber" described herein is not limited to a meaning as a space formed when a piston reaches a compression top dead point. The term "combustion chamber" is used in a broad sense.

According to this configuration, the inner wall surface of the opposite first intake port side portion at the downstream end portion of the second intake port extends, along an intake air flow direction, to gradually approach the first intake port. Thus, part of intake air passing through the second intake port is, along the inner wall surface, guided to the first intake port side in the engine output axis direction. The ignition plug is provided on the first intake port side, and therefore, when the intake air guided by the inner wall surface flows into the combustion chamber, such air flows in the vicinity of the ignition plug. Thus, a sufficient intensity of turbulence right below the ignition plug can be ensured, and therefore, air-fuel mixture ignition performance can be ensured.

Moreover, as viewed in a section perpendicular to a cylinder axis, the inner wall surface of the opposite first intake port side portion of the second intake port may be formed such that an extension extending in a gas flow direction along the inner wall surface crosses a straight line passing perpendicularly to the engine output axis through the ignition plug.

According to this configuration, intake air passing through the second intake port is guided to flow inward of the combustion chamber. Thus, it is advantageous in ensuring of a sufficient intensity of turbulence right below the ignition plug.

Further, in a case where a downstream end portion of the first intake port is divided into a second intake port side and an opposite second intake port side in the engine output axis direction, an inner wall surface of an opposite second intake port side portion may extend, as viewed in the section perpendicular to the cylinder axis, substantially perpendicularly to the engine output axis as extending from an upstream side to a downstream side of the first intake port, and an inner wall surface of a second intake port side portion may extend in a direction apart from the second intake port as extending from the upstream side to the downstream side of the first intake port.

According to this configuration, the inner wall surface of the second intake port side portion at the downstream end portion of the first intake port extends, along the intake air flow direction, gradually apart from the second intake port. Thus, part of intake air passing through the first intake port is, along the inner wall surface, guided to the opposite second intake port side in the engine output axis direction. When the intake air guided as described above flows into the combustion chamber, such air flows, in the engine output axis direction, apart from intake air having flowed in through the second intake port. This prevents the flow of intake air having flowed in through the first intake port from interfering with the flow of intake air having flowed in through the second intake port. This is effective in ensuring of a sufficient intensity of turbulence right below the ignition plug.

In addition, an internal combustion engine may include a fuel injection valve configured to supply fuel into the combustion chamber, and the fuel injection valve may be, at the ceiling surface of the combustion chamber, arranged next to the ignition plug in a direction perpendicular to the engine output axis.

According to this configuration, intake air having flowed in through the second intake port flows in the vicinity of the fuel injection valve. Fuel is injected to such a main flow, and therefore, it is advantageous in formation of a homogeneous air-fuel mixture in the vicinity of the ignition plug.

Moreover, the internal combustion engine may include an intake valve provided at each of the first intake port and the second intake port and configured to open or close the intake opening. The intake valve may include a shaft portion reciprocating up and down, and a shade portion connected to a lower end portion of the shaft portion and configured to contact the intake opening from the inside of the combustion chamber to close the intake opening. When a corresponding one of the intake valves opens the intake opening, each of the downstream end portion of the first intake port and the downstream end portion of the second intake port may extend, as viewed in a section perpendicular to the engine output axis, to direct to between a shade back of a portion of the shade portion positioned on a cylinder axis side with respect to the shaft portion and the ceiling surface facing the shade back.

According to this configuration, the first intake port and the second intake port are both in a tumble port shape. In this case, intake air having flowed in through the second intake port is, for example, guided to flow between a shade surface and the ceiling surface. The intake air guided as described above flows downward in a longitudinal direction (the cylinder axis direction) from a cylinder inner peripheral surface on the opposite side of the cylinder axis from the intake valve, and thereafter, flows upward to the intake valve in the longitudinal direction. In this manner, the intake air having flowed into the combustion chamber generates a swirling flow about a center axis parallel to the engine output axis. Thus, in the combustion chamber, the intensity of a tumble flow is increased. The same applies to the first intake port.

In comparison with a swirl flow, the tumble flow is relatively smaller in terms of expansion in the engine output axis direction. In a case where the intake port is in the tumble port shape, intake air having flowed into the combustion chamber through the intake port flows in the longitudinal direction right below the intake opening connected to the intake port. Accordingly, the intensity of turbulence is relatively weakened right below an ignition plug portion, and therefore, it is disadvantageous in ensuring the air-fuel mixture ignition performance.

Particularly when the intake port is in the tumble port shape, the above-described configuration is effective on such a point that a sufficient intensity of turbulence right below the ignition plug can be ensured.

Advantages of the Invention

As described above, according to the above-described internal combustion engine intake port structure, a sufficient intensity of turbulence right below the ignition plug can be ensured, and therefore, the air-fuel mixture ignition performance can be ensured.

DESCRIPTION OF EMBODIMENTS

Figure 1:
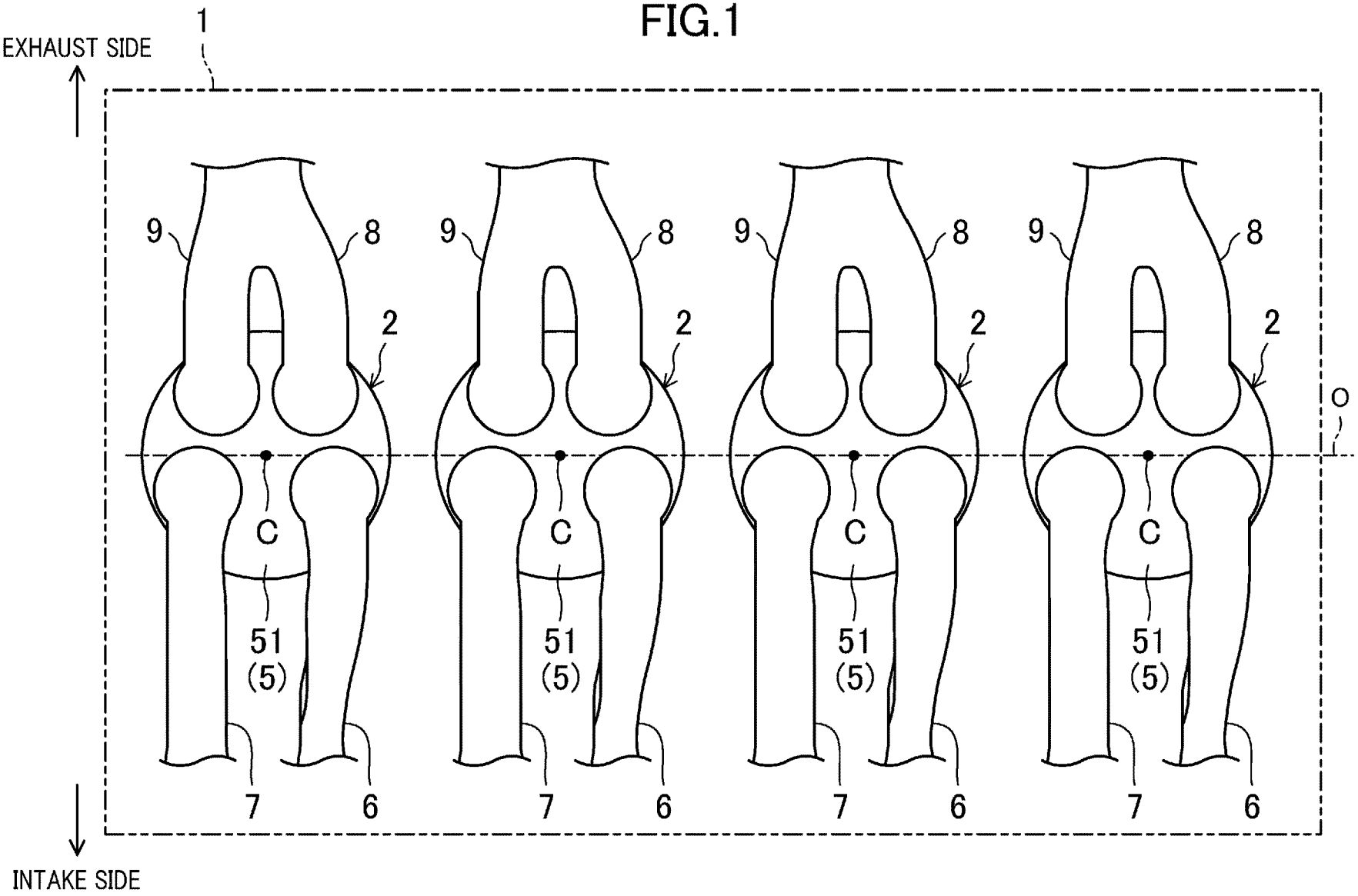
FIG. 1 is a plan view of an example of an engine.
Figure 2:
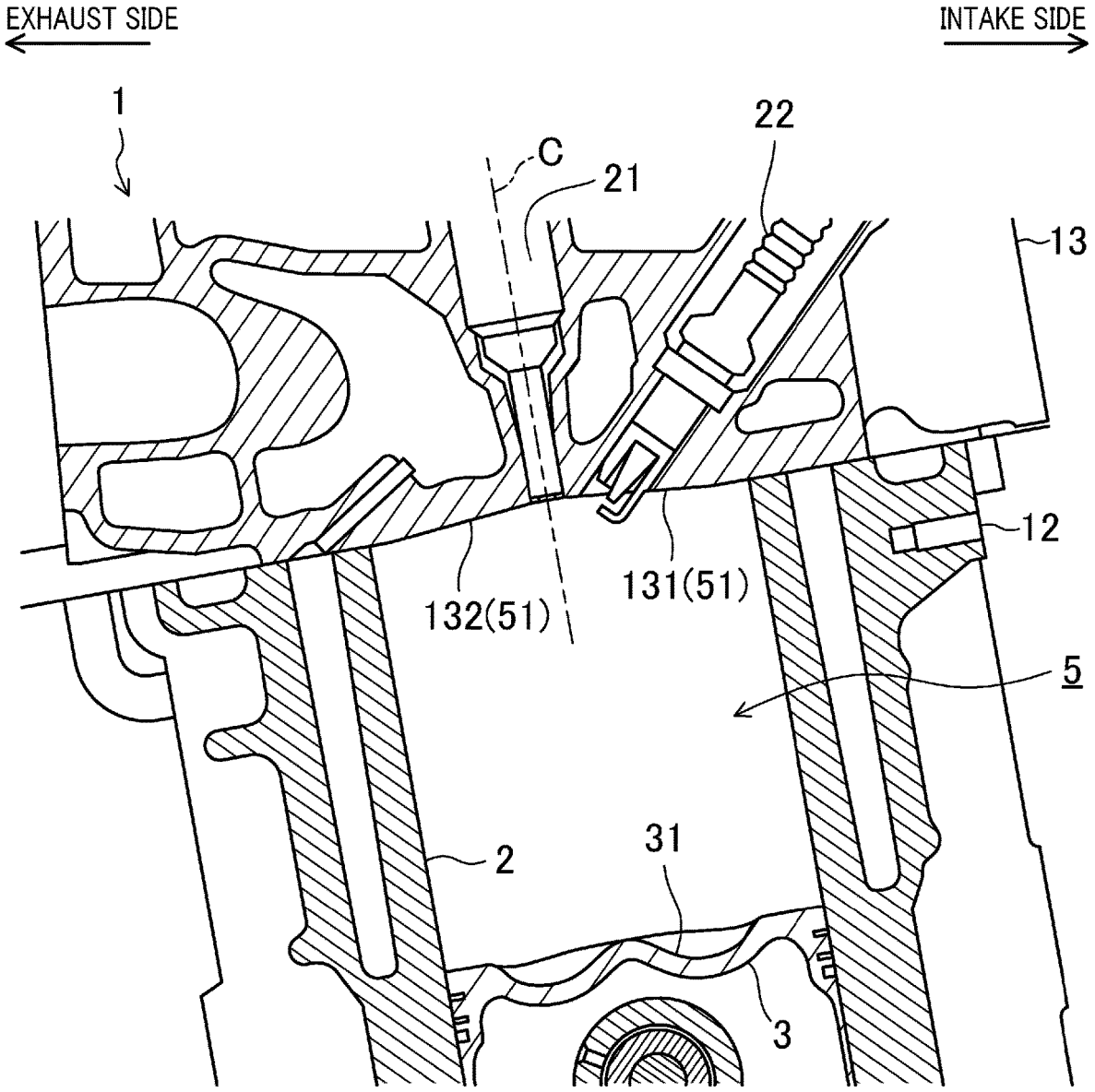
FIG. 2 is a longitudinal sectional view of an example of an outline configuration of a combustion chamber.
Figure 3:
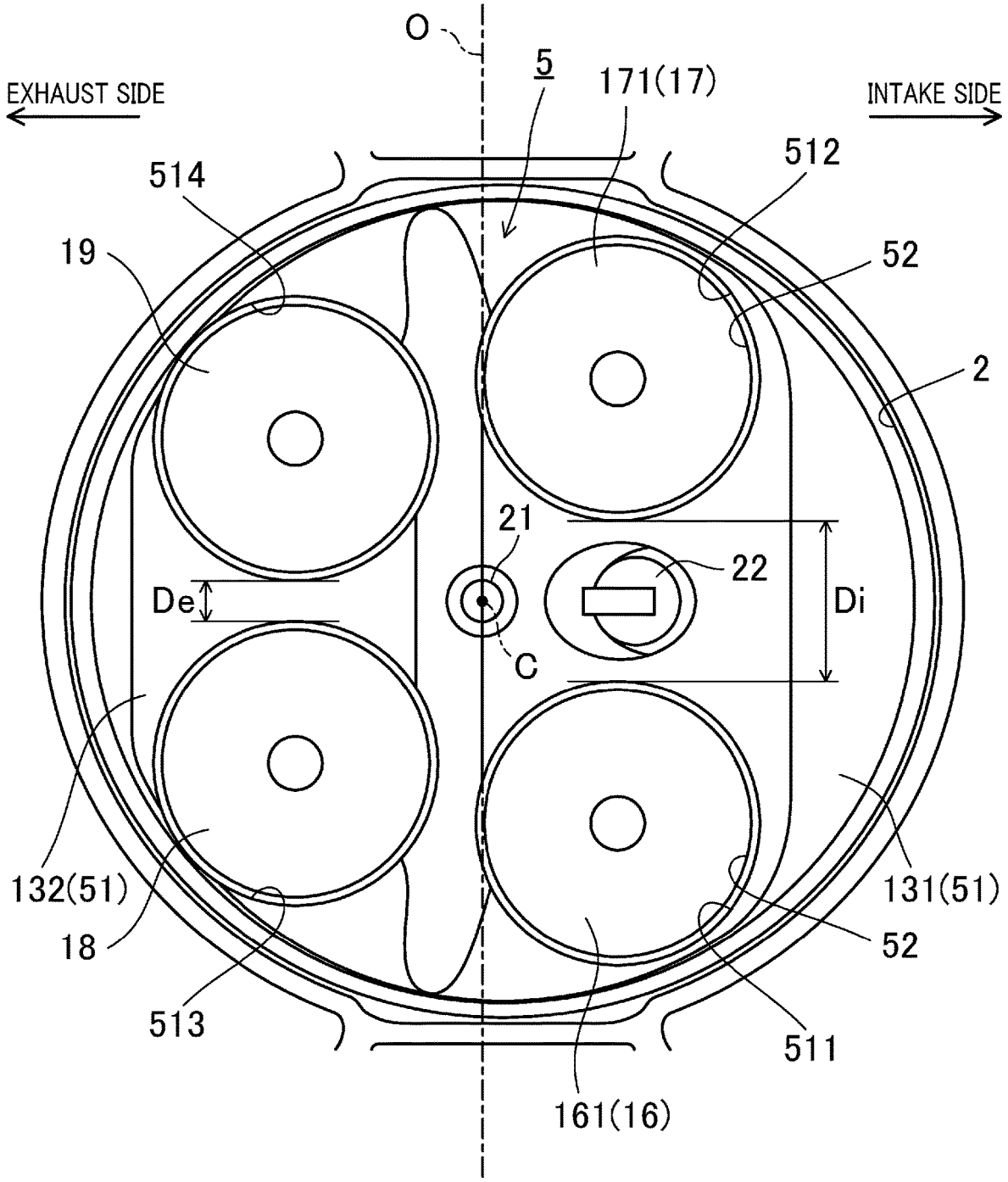
FIG. 3 is a view of an example of a ceiling surface of the combustion chamber.

Hereinafter, an embodiment of an intake port structure of an internal combustion engine will be described in detail with reference to the drawings. Note that description below is made by way of example. FIG. 1 is a view of an engine to which the intake port structure of the internal combustion engine disclosed herein is applied. Moreover, FIG. 2 is a longitudinal sectional view of an example of an outline configuration of a combustion chamber, and FIG. 3 is a view of an example of a ceiling surface of the combustion chamber.

Note that in description below, an "intake side" is a right side on the plane of paper of FIGS. 1, 2, and 3. Moreover, an "exhaust side" is a left side on the plane of paper of FIGS. 1, 2, and 3. Hereinafter, a direction from the intake side to the exhaust side and a direction from the exhaust side to the intake side will be each sometimes referred to as an "intake-exhaust direction." In other figures, directions corresponding to these directions will be referred to as an "intake side," an "exhaust side," and an "intake-exhaust direction."

As illustrated in FIG. 1, an engine 1 is an internal combustion engine configured such that four cylinders 2 are provided in series. Specifically, the engine 1 according to the present embodiment is an in-line four-cylinder four-stroke internal combustion engine, and is configured as a direct injection gasoline engine.

Outline Configuration of Engine

As illustrated in FIG. 2, the engine 1 includes a cylinder block 12 and a cylinder head 13 mounted on the cylinder block 12. In the cylinder block 12, four cylinders 2 are formed (FIG. 2 illustrates only one cylinder 2).

Returning to FIG. 1, four cylinders 2 are arranged in a center axis O (hereinafter referred to as an "engine output axis") direction of a crankshaft (not shown). Each of four cylinders 2 is formed in a cylindrical shape, and center axes (hereinafter referred to as "cylinder axes") C of the cylinders 2 extend in parallel to each other and extend perpendicularly to the engine output axis O direction. Hereinafter, a configuration of one of four cylinders 2 will be described.

A piston 3 is slidably inserted into each cylinder 2. The piston 3 is coupled to the crankshaft through a connecting rod (not shown).

A cavity 31 is formed at an upper surface of the piston 3. The cavity 31 is recessed from the upper surface of the piston 3. When the piston 3 is positioned in the vicinity of a compression top dead point, the cavity 31 faces a later-described fuel injection valve 21.

The piston 3, the cylinder 2, and the cylinder head 13 form a combustion chamber 5. The "combustion chamber" described herein is not limited to a meaning as a space formed when the piston 3 reaches the compression top dead point. In some cases, the term "combustion chamber" is used in a broad sense. That is, regardless of the position of the piston 3, the "combustion chamber" means, in some cases, a space formed by the piston 3, the cylinder 2, and the cylinder head 13.

A ceiling surface 51 of the combustion chamber 5 is in a so-called pent roof shape, and is formed by a lower surface of the cylinder head 13. Specifically, when the combustion chamber 5 is viewed in the engine output axis O direction, the ceiling surface 51 includes an intake side inclined surface 131 with a rising slope from the intake side to the cylinder axis C, and an exhaust side inclined surface 132 with a rising slope from the exhaust side to the cylinder axis C.

The engine 1 according to the present embodiment is configured such that the ceiling surface 51 of the combustion chamber 5 is formed low for enhancing a geometric compression ratio. The pent roof shape of the ceiling surface 51 is close to a flat shape.

At the ceiling surface 51 of the combustion chamber 5, a first intake opening 511 and a second intake opening 512 open. As illustrated in FIG. 3, the first intake opening 511 and the second intake opening 512 are arranged along the engine output axis O direction on the intake side (specifically the intake side inclined surface 131) with respect to the engine output axis O when the combustion chamber 5 is viewed in a cylinder axis C direction. A ring-shaped valve seat 52 is arranged at each of peripheral edge portions of the first intake opening 511 and the second intake opening 512.

In addition to the first intake opening 511 and the second intake opening 512, two exhaust openings 513, 514 open at the ceiling surface 51 of the combustion chamber 5. As illustrated in FIG. 3, two exhaust openings 513, 514 are arranged along the engine output axis O direction on the exhaust side (specifically the exhaust side inclined surface 132) with respect to the engine output axis O when the combustion chamber 5 is viewed in the cylinder axis C direction.

At an intake side portion of the cylinder head 13, two intake ports 6, 7 are formed for each cylinder 2. Each of two intake ports 6, 7 extends from the intake side to the combustion chamber 5, and is configured such that an intake path (not shown) in an intake manifold communicates with the combustion chamber 5. Intake air having passed through the intake path is sucked into the combustion chamber 5 through the intake ports 6, 7.

Specifically, two intake ports 6, 7 include a first intake port 6 connected to the first intake opening 511, and a second intake port 7 arranged next to the first intake port 6 in the engine output axis O direction.

The first intake port 6 communicates with the combustion chamber 5 through the first intake opening 511. A first intake valve (hereinafter referred to as a "first valve") 16 is arranged at the first intake port 6. The first valve 16 is driven by a not-shown valve mechanism (e.g., a DOHC mechanism), and reciprocates up and down to open or close the first intake opening 511.

Specifically, the first valve 16 is configured as a so-called poppet valve. Specifically, the first valve 16 has a valve stem (a shaft portion) 161 reciprocating up and down, and a valve head 162 (a shade portion) connected to a lower end portion of the valve stem 161 and configured to contact the first intake opening 511 from the inside (the inner side) of the combustion chamber 5 to close the first intake opening 511 from the inside of the combustion chamber 5.

The valve stem 161 is inserted into a cylindrical valve guide (not shown), and is movable up and down in an axial direction. A lower end portion of the valve stem 161 is connected to a shade back 162*a* of the valve head 162. On the other hand, an upper end portion of the valve stem 161 is coupled to the above-described valve mechanism.

The valve head 162 is configured such that the shade back 162*a* closely contacts the valve seat 52 of the first intake opening 511 to close the first intake opening 511 from the inside of the combustion chamber 5. When the first valve 16 moves downward from such a state, the shade back 162*a* and the valve seat 52 are separated from each other to open the first intake opening 511. In this state, the flow rate of intake air flowing into the combustion chamber 5 through the first intake port 6 is adjusted according to a clearance (a so-called valve lift amount) between the shade back 162*a* and the valve seat 52.

Similarly, the second intake port 7 communicates with the combustion chamber 5 through the second intake opening 512. A second intake valve (hereinafter referred to as a "second valve") 17 is arranged at the second intake port 7. The second valve 17 reciprocates up and down to open or close the second intake opening 512.

As in the first valve 16, the second valve 17 includes a valve stem 171 as a shaft portion and a valve head 172 as a shade portion. A lower end portion of the valve stem 171 is connected to a shade back 172*a* of the valve head 172.

Note that the first intake port 6 and the second intake port 7 according to the present embodiment are both in a so-called tumble port shape. That is, each of the first intake port 6 and the second intake port 7 is configured such that intake air flowing into the combustion chamber 5 generates a tumble flow in the combustion chamber 5. Details of each of the intake ports 6, 7 will be described later.

Moreover, the first valve 16 and the second valve 17 open or close the corresponding intake openings 511, 512 at the substantially same timing. For example, when the first valve 16 opens the first intake opening 511, the second valve 17 also opens the second intake opening 512 at the substantially same timing. Thus, intake air flowing into the combustion chamber 5 through the first intake port 6 and intake air flowing into the combustion chamber 5 through the second intake port 7 generate the tumble flow at the substantially same timing in the combustion chamber 5.

On the other hand, at an exhaust side portion of the cylinder head 13, two exhaust ports 8, 9 are formed for each cylinder 2. Each of two exhaust ports 8, 9 extends from the exhaust side to the combustion chamber 5, and is configured such that the combustion chamber 5 communicates with an exhaust path (not shown) in an exhaust manifold. Gas discharged from the combustion chamber 5 flows into the exhaust path through the exhaust ports 8, 9.

Of two exhaust ports 8, 9, one exhaust port 8 communicates with the combustion chamber 5 through the exhaust opening 513. An exhaust valve 18 configured to open or close the exhaust opening 513 is arranged at the exhaust port 8. Similarly, the other exhaust port 9 communicates with the combustion chamber 5 through the exhaust opening 514. An exhaust valve 19 configure to open or close the exhaust opening 514 is arranged at the exhaust port 9.

Moreover, for each cylinder 2, the fuel injection valve 21 configured to supply fuel to the inside of the combustion chamber 5 and an ignition plug 22 configured to ignite an air-fuel mixture in the combustion chamber 5 are provided at the cylinder head 13.

The fuel injection valve 21 is provided at a substantially center portion (specifically, a pent roof ridge line at which the intake side inclined surface 131 and the exhaust side inclined surface 132 cross each other) of the ceiling surface 51, and is arranged such that an injection axis thereof is along the cylinder axis C. The fuel injection valve 21 is arranged such that an injection port thereof faces the inside of the combustion chamber 5, and is configured to directly inject fuel into the combustion chamber 5.

The ignition plug 22 is arranged on the intake side with respect to the cylinder axis C, and is positioned between the first intake port 6 and the second intake port 7. As illustrated in FIG. 3, the first intake port 6, the ignition plug 22, and the second intake port 7 are arranged in this order along the engine output axis O direction, and the ignition plug 22 is provided at the substantially center of the ceiling surface 51 in the engine output axis O direction. The ignition plug 22 is inclined in a direction toward the cylinder axis C from an upper side to a lower side. As illustrated in FIG. 3, an electrode of the ignition plug 22 faces the inside of the combustion chamber 5, and is positioned in the vicinity of the ceiling surface 51 of the combustion chamber 5.

Note that in a case where the ignition plug 22 is arranged between two intake ports 6, 7, a distance Di between the first intake port 6 and the second intake port 7 is increased by a length corresponding to the dimension of the ignition plug 22 along the engine output axis O direction. Thus, the distance Di is longer than a distance De between two exhaust ports 8, 9.

Moreover, as illustrated in FIG. 3, the fuel injection valve 21 and the ignition plug 22 are arranged in the intake-exhaust direction perpendicular to the engine output axis O.

When the engine 1 configured as described above is operated, intake air having passed through the intake path flows into the combustion chamber 5 through the intake ports 6, 7. Then, an intake air flow is formed according to the forms of the intake ports 6, 7 in the combustion chamber 5. For example, when fuel is injected to intake air flowing in the combustion chamber 5 in the vicinity of the compression top dead point, an air-fuel mixture of the intake air and the fuel is formed. Then, when the air-fuel mixture is ignited, combustion occurs at a predetermined combustion speed, and accordingly, power is obtained. A thermal efficiency in this state is higher when the combustion speed is high than when the combustion speed is low. The combustion speed increases as the intensity of turbulence of the intake air among state variables according to the intake air flow increases.

That is, the intensity of turbulence of the intake air is increased so that the thermal efficiency of the engine 1 can be increased. In addition, the intensity of turbulence of the intake air is increased so that homogeneity of the air-fuel mixture can be enhanced. The intake ports 6, 7 according to the present embodiment are, as described above, in the tumble port shape. With this configuration, high tumble of the intake air can be realized, and therefore, the intensity of turbulence can be increased.

Configuration of Intake Port

Hereinafter, a configuration common to the first intake port 6 and the second intake port 7 will be described. Note that in description below, a "downstream" indicates a downstream in an intake air flow direction. Similarly, an "upstream" indicates an upstream in the intake air flow direction.

Figure 4:
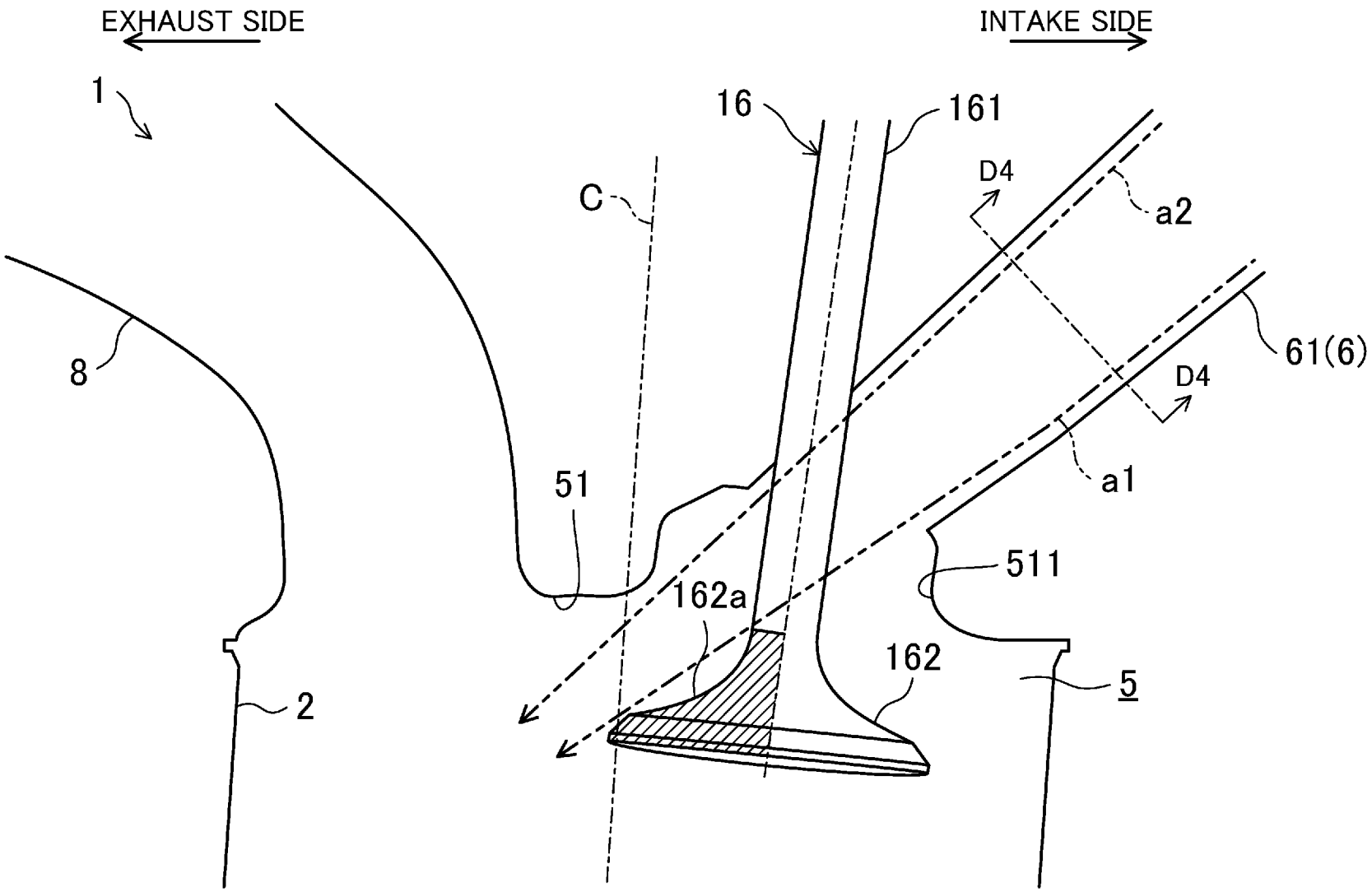
FIG. 4 is a view for describing a state in which an intake valve opens an intake opening.

FIG. 4 is a view for describing a state in which the first valve 16 opens the first intake opening 511.

Each of the intake ports 6, 7 is formed in a substantially cylindrical shape.

As viewed in the cylinder axis C direction, an upstream side portion in a case where the intake port 6, 7 is divided into the upstream side and the downstream side extends, as illustrated in FIG. 1, substantially perpendicularly to both of the cylinder axis C and the engine output axis O to obtain a strong tumble flow, and extends substantially straight along a direction (i.e., the direction from the intake side to the exhaust side in the intake-exhaust direction) from the intake side to the cylinder axis C to reduce pipe resistance.

On the other hand, as viewed in a section perpendicular to the engine output axis O, a downstream side portion of the intake port 6, 7 is diagonally inclined with respect to the cylinder axis C. Specifically, as illustrated in FIG. 4, when the engine 1 is viewed in the engine output axis O direction, a downstream end portion 61 of the first intake port 6 extends downward (a combustion chamber 5 side in the cylinder axis C direction) from a position separated upward from the combustion chamber 5 as extending from the intake side to the cylinder axis C, and is connected to the first intake opening 511 of the ceiling surface 51. The same applies to a downstream end portion 71 of the second intake port 7.

When the first valve 16 as the intake valve corresponding to the first intake port 6 opens the first intake opening 511 (at least when the valve lift amount of the first valve 16 reaches the maximum amount), the downstream end portion 61 of the first intake port 6, specifically the lower half of the downstream end portion 61, extends to direct to between the shade back 162*a* of the valve head 162 positioned on a cylinder axis C side with respect to the valve stem 161 and the ceiling surface 51 facing the shade back 162*a* as viewed in the section perpendicular to the engine output axis O (see arrows a1 to a2 of FIG. 4).

With this configuration, when the first valve 16 opens the first intake opening 511, intake air having flowed into the combustion chamber 5 through the first intake port 6 is guided to flow between the shade back 162*a* and the ceiling surface 51 facing the shade back 162*a*. The intake air guided as described above flows downward in a longitudinal direction (the cylinder axis C direction) from an inner peripheral surface of the cylinder 2 on the opposite side (i.e., the exhaust side) of the cylinder axis C from the first valve 16, and thereafter, flows upward in the longitudinal direction to the intake valve 16. In this manner, the intake air having flowed into the combustion chamber 5 generates a swirling flow about a center axis parallel to the engine output axis O. Thus, the intensity of the tumble flow is increased in the combustion chamber 5. The same applies to the second intake port. The same configuration as described above also applies to the second intake port 7. The downstream end portion 71 of the second intake port 7 is also configured to increase the intensity of the tumble flow.

Moreover, the downstream end portions 61, 71 of the intake ports 6, 7 are gradually diameter-narrowed from the upstream side to the downstream side of the intake ports 6, 7. The diameter of each of the intake ports 6, 7 is narrowed so that the inflow speed of intake air flowing into the combustion chamber 5 through each of the intake ports 6, 7 can be increased. Thus, the intensity of the tumble flow can be further increased.

Next, a configuration unique to the first intake port 6 will be described.

Figure 5:
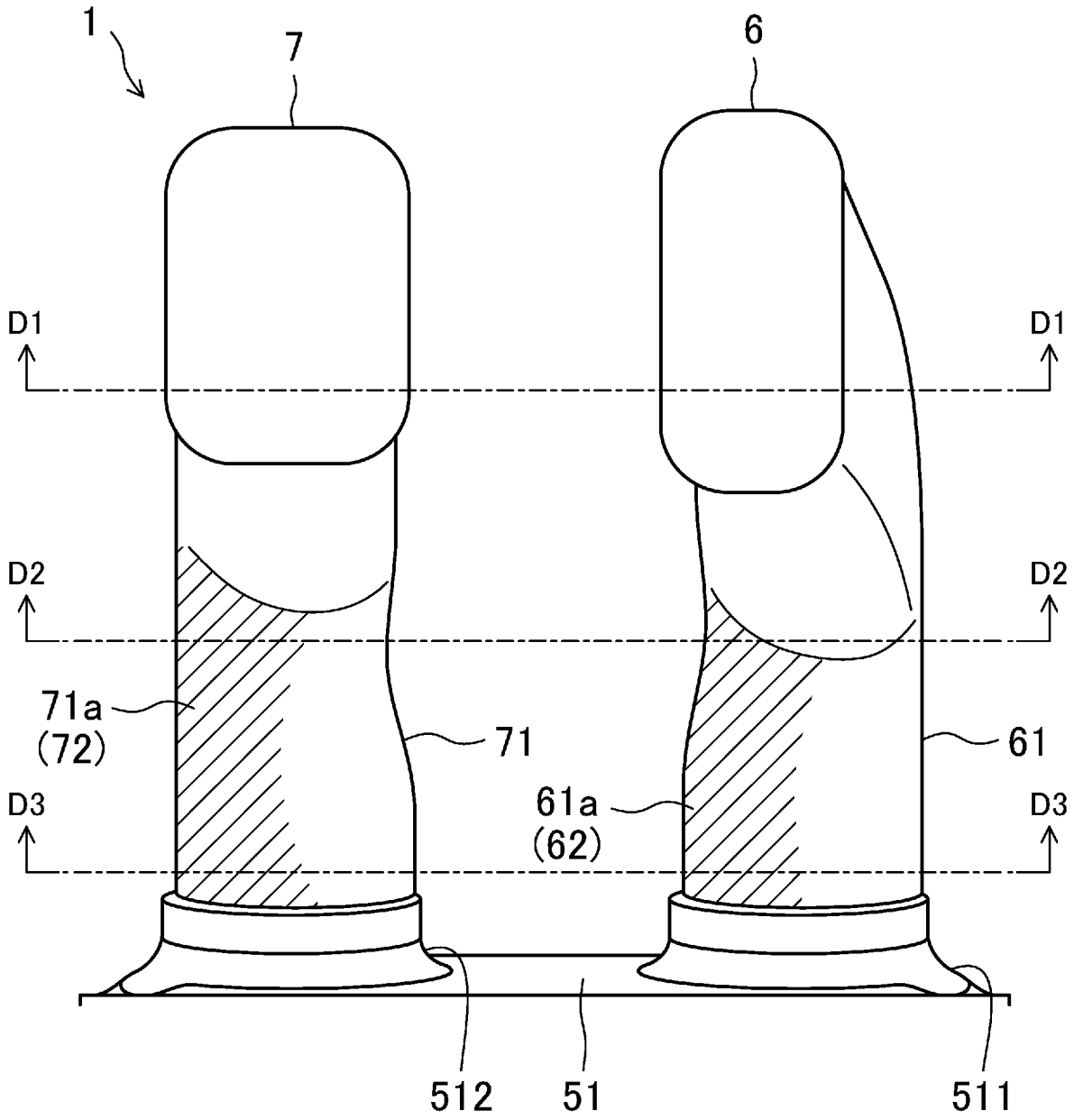
FIG. 5 is a view of an outline form of an intake port as viewed from an intake side to an exhaust side.

FIG. 5 is a view of the outline forms of the intake ports 6, 7 as viewed from the intake side to the exhaust side. FIG. 5 mainly illustrates the shapes of the intake ports 6, 7.

Figure 6:
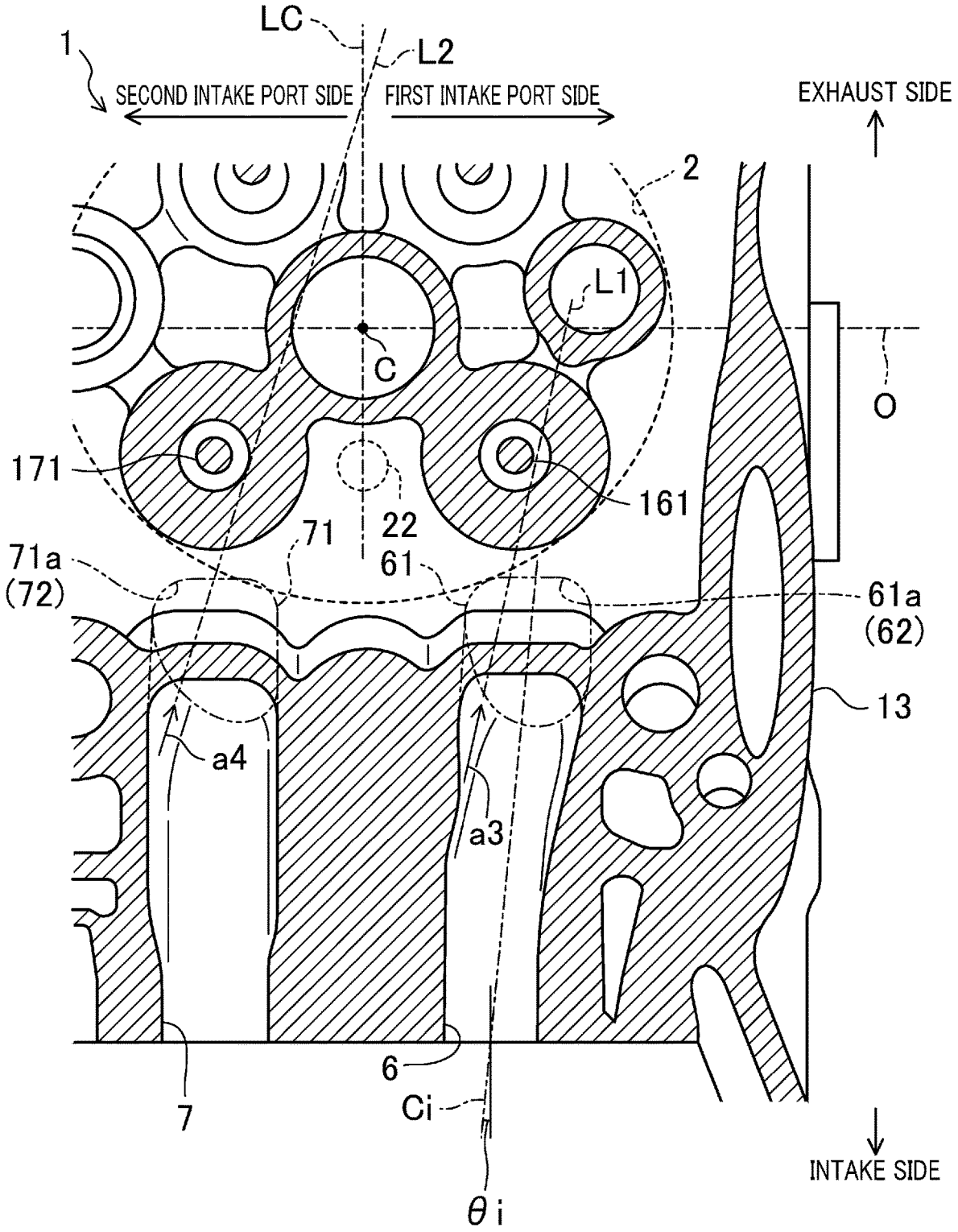
FIG. 6 is a sectional view of the intake port along a D1-D1 line.
Figure 7:
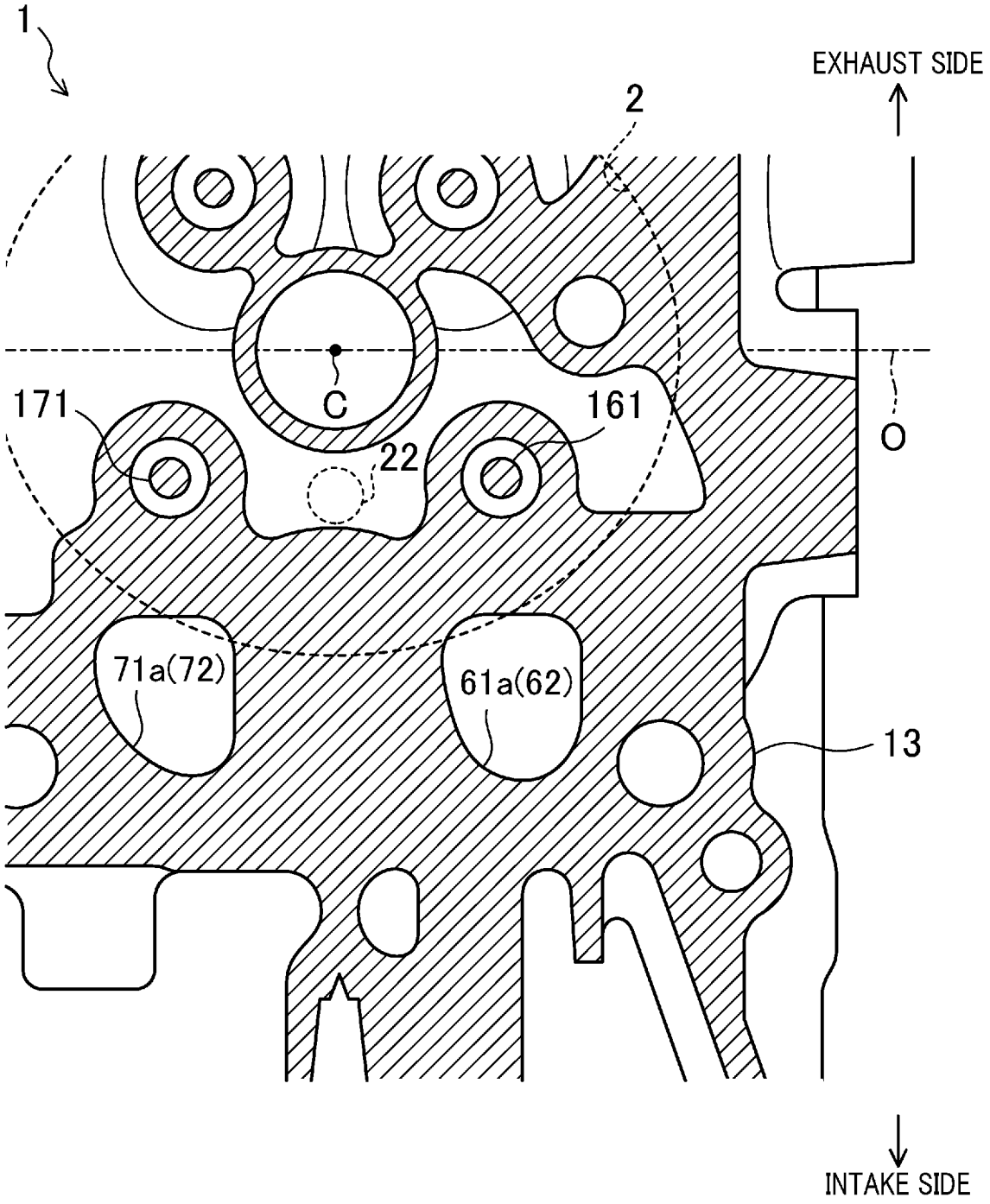
FIG. 7 is a sectional view of the intake port along a D2-D2 line.
Figure 8:
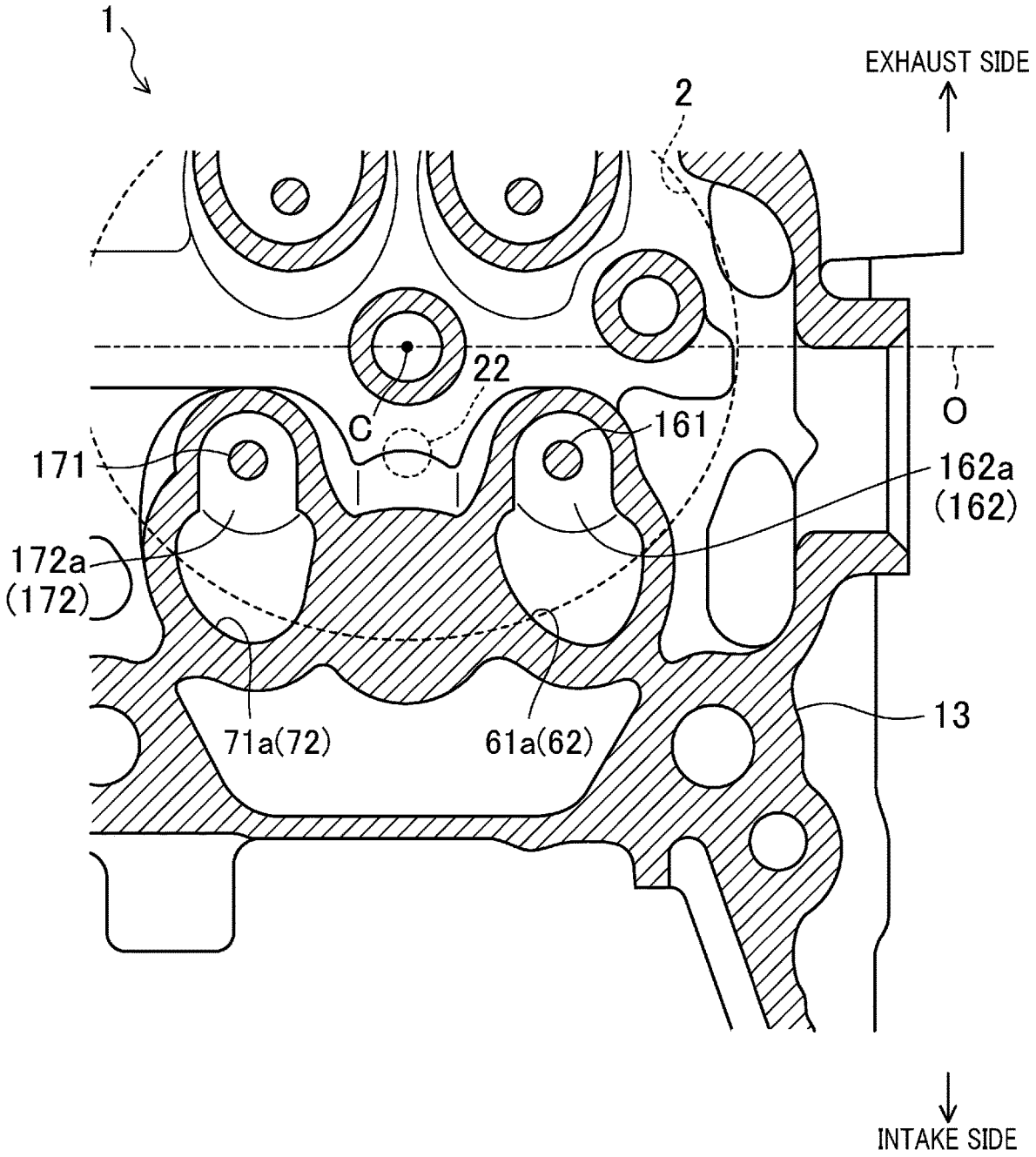
FIG. 8 is a sectional view of the intake port along a D3-D3 line.
Figure 9:
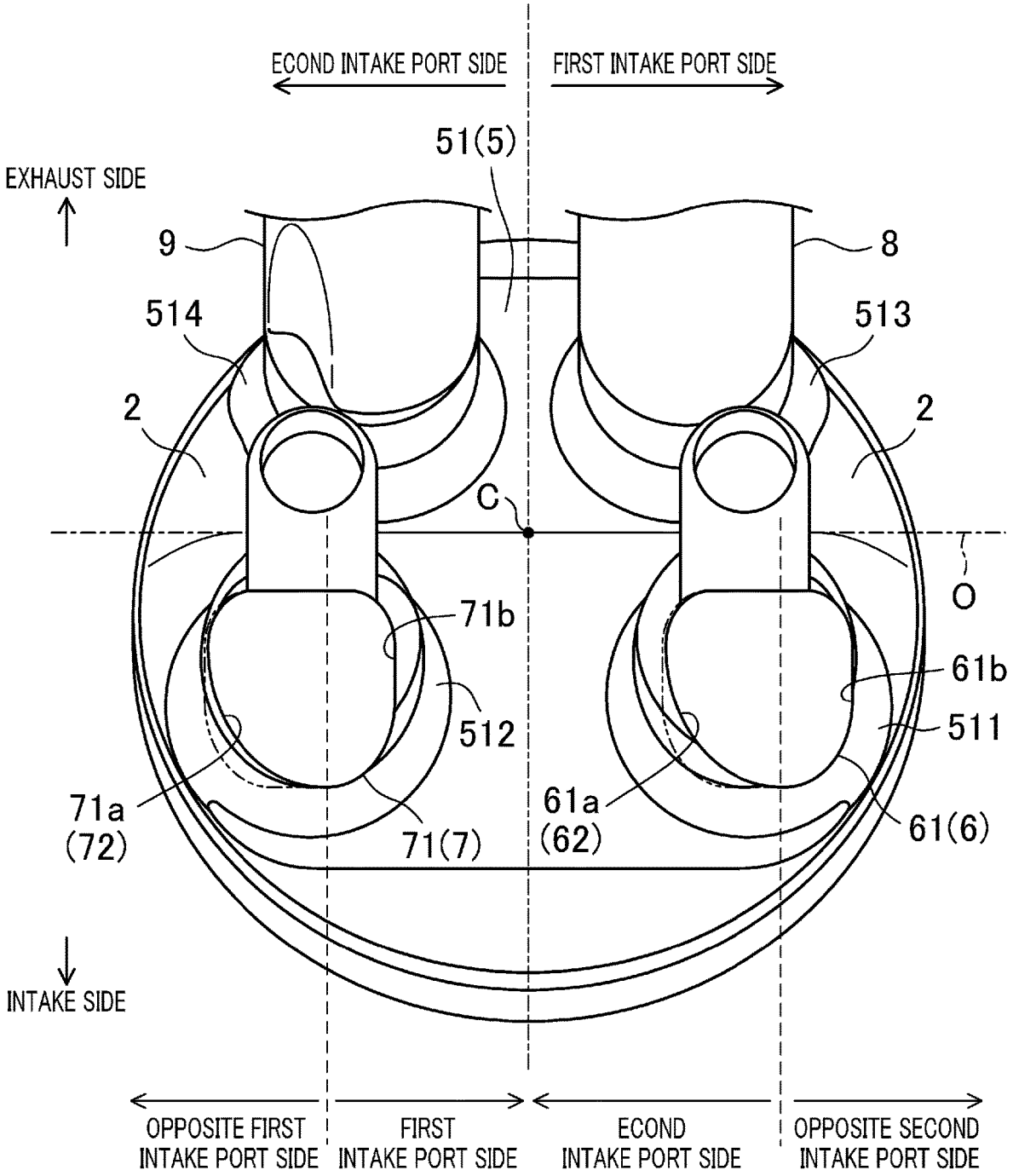
FIG. 9 is a cross-sectional view of an example of the outline form of the intake port.

These shapes correspond to the shape of a core cylinder upon casting of the cylinder head 13. Moreover, FIG. 6 is a sectional view of the intake ports 6, 7 along a D1-D1 line. Similarly, FIG. 7 is a sectional view of the intake ports 6, 7 along a D2-D2 line, and FIG. 8 is a sectional view of the intake ports 6, 7 along a D3-D3 line. In addition, FIG. 9 is a cross-sectional view (specifically, a section of FIG. 4 along a D4-D4 line) of an example of the outline forms of the intake ports 6, 7. As in FIG. 6, FIG. 9 also corresponds to the shape of the core cylinder upon casting of the cylinder head 13.

In a case where the downstream end portion 61 of the first intake port 6 is divided into a second intake port 7 side (the left side on the plane of paper) and an opposite second intake port 7 side (the right side on the plane of paper) as viewed in the cylinder axis C direction, an inner wall surface (hereinafter referred to as an "opposite second intake port side inner wall surface") 61*b* of the opposite second intake port 7 side portion is formed in a semi-square tubular shape as illustrated in FIG. 9. A right side surface (a surface extending up and down on the right side on the plane of paper of FIG. 6) and a bottom surface of the opposite second intake port side inner wall surface 61*b* cross each other at a substantially right angle.

Moreover, the opposite second intake port side inner wall surface 61*b* of the first intake port 6 extends substantially straight as in the above-described upstream side portion. That is, as illustrated in FIGS. 6 to 8, the opposite second intake port side inner wall surface 61*b* extends, as viewed in the section perpendicular to the cylinder axis C, substantially perpendicularly to the engine output axis O from the upstream side to the downstream side of the first intake port 6.

On the other hand, at an inner wall surface (hereinafter referred to as a "second intake port side inner wall surface") 61*a* of the second intake port 7 side portion at the downstream end portion 61 of the first intake port 6, a first orientation surface 62 for directing the intake air flow, which flows toward the combustion chamber 5 along the inner wall surface 61*a*, in a direction toward the opposite second intake port 7 side in the combustion chamber 5 is formed.

The "direction toward the opposite second intake port 7 side in the combustion chamber 5" as described herein is equal to a direction from a space on an opposite first intake port 6 side to a space on the opposite second intake port 7 side in a case where a space inside the combustion chamber 5 is divided into the opposite second intake port 7 side (a first intake port 6 side) and the opposite first intake port 6 side (the second intake port 7 side) in the engine output axis O direction, as illustrated in FIG. 9.

Specifically, as viewed in a section perpendicular to a direction from the upstream side to the downstream side of the first intake port 6, the second intake port side inner wall surface 61*a* gradually curves apart from the second intake port 7 in the direction from the exhaust side (the other side with respect to the engine output axis O) to the intake side (one side) as compared to the shape (see a chain double-dashed line) of the opposite second intake port 7 side inner wall surface 61*b* mirror-reversed to the second intake port 7 side. Such a curved portion forms the first orientation surface 62.

More specifically, as illustrated in FIGS. 6 to 9, the second intake port side inner wall surface 61*a* curves from the left half to the lower half of the inner surface 61*a* at the first intake port 6. As viewed in the section illustrated in FIG. 9, the second intake port side inner wall surface 61*a* is formed as a curved surface curving with an inclination with respect to the intake-exhaust direction. The second intake port side inner wall surface 61*a* has a smaller curvature than that of the opposite second intake port side inner wall surface 61*b*, and relatively gently curves.

As illustrated in FIG. 6, the center axis Ci of the downstream end portion 61 of the first intake port 6 extends in a direction apart from the second intake port 7 as extending from the upstream side to the downstream side of the first intake port 6. Specifically, when the engine 1 is viewed in the cylinder axis C direction, the center axis Ci is inclined by a predetermined inclination angle θi with respect to one direction from the intake side to the exhaust side in the intake-exhaust direction. The inclination angle θi is an acute angle. As a result of such inclination, the second intake port side inner wall surface 61*a* extends, as indicated by an arrow a3 of FIG. 6, in the direction apart from the second intake port 7 as extending from the upstream side to the downstream side of the first intake port 6.

In addition, as illustrated in FIG. 6, the second intake port side inner wall surface 61*a* is, at the first intake port 6, formed such that an extension Li in the intake air flow direction along the inner wall surface 61*a* is toward a region (i.e., a region on the exhaust side) on the opposite side of the first intake opening 511 and the second intake opening 512 with respect to the engine output axis O.

Next, a configuration unique to the second intake port 7 will be described.

In a case where the downstream end portion 71 of the second intake port 7 is divided into the first intake port 6 side (the right side on the plane of paper) and the opposite first intake port 6 side (the left side on the plane of paper), an inner wall surface (hereinafter referred to as a "first intake port side inner wall surface") 71*b* of the first intake port 6 side portion is formed in a semi-square tubular shape as illustrated in FIG. 9. A right side surface and a bottom surface of the first intake port side inner wall surface 71*b* cross each other at a substantially right angle, and the curvature of the first intake port side inner wall surface 71*b* is at least greater than the curvature of the second intake port side inner wall surface 61*a* at the first intake port 6.

Moreover, the first intake port side inner wall surface 71*b* of the second intake port 7 extends substantially straight as in the above-described upstream side portion. That is, as illustrated in FIGS. 6 to 8, the first intake port side inner wall surface 71*b* extends substantially perpendicularly to the engine output axis O as extending from the upstream side to the downstream side of the second intake port 7 as viewed in the section perpendicular to the cylinder axis C.

On the other hand, at an inner wall surface (hereinafter referred to as an "opposite first intake port side inner wall surface") 71*a* of the opposite first intake port 6 side portion at the downstream end portion 71 of the second intake port 7, a second orientation surface 72 for directing the intake air flow, which flows toward the combustion chamber 5 along the inner wall surface 71*a*, in a direction toward the first intake port 6 side in the combustion chamber 5 is formed.

The "direction toward the first intake port 6 side in the combustion chamber 5" described herein is equal to the above-described "direction toward the opposite second intake port 7 side in the combustion chamber 5."

Specifically, as viewed in a section perpendicular to a direction from the upstream side to the downstream side of the first intake port 7, the opposite first intake port side inner wall surface 71*a* curves to gradually approach the first intake port 6 in the direction from the exhaust side (the other side with respect to the engine output axis O) to the intake side (one side) as compared to the shape (see a chain double-dashed line) of the first intake port side inner wall surface 71*b* mirror-reversed to the opposite first intake port 6 side. Such a curved portion forms the second orientation surface 72.

More specifically, as illustrated in FIGS. 6 to 9, the opposite first intake port side inner wall surface 71*a* curves from the left half to the lower half of the inner wall surface 71*a* at the second intake port 7. As viewed in the section illustrated in FIG. 9, the opposite first intake port side inner wall surface 71*a* is formed as a curved surface curving with an inclination with respect to the intake-exhaust direction. The opposite first intake port side inner wall surface 71*a* has a smaller curvature than that of the first intake port side inner wall surface 71*b*, and relatively gently curves.

In addition, at the second intake port 7, the opposite first intake port side inner wall surface 71*a* extends, as indicated by an arrow a4 of FIG. 6, in the direction toward the first intake port 6 as extending from the upstream side to the downstream side of the second intake port 7.

Specifically, the opposite first intake port side inner wall surface 71*a* is formed such that an extension L2 extending in the intake air (gas) flow direction along the inner wall surface 71*a* crosses, as viewed in the section perpendicular to the cylinder axis C, a center line LC as a straight line (in the present embodiment, a straight line passing parallel to the intake-exhaust direction through the cylinder axis C) passing perpendicularly to the engine output axis O through the ignition plug 22. The extension L2 and the center line LC cross each other in the combustion chamber 5.

Intake Air Flow in Combustion Chamber

Figure 10:
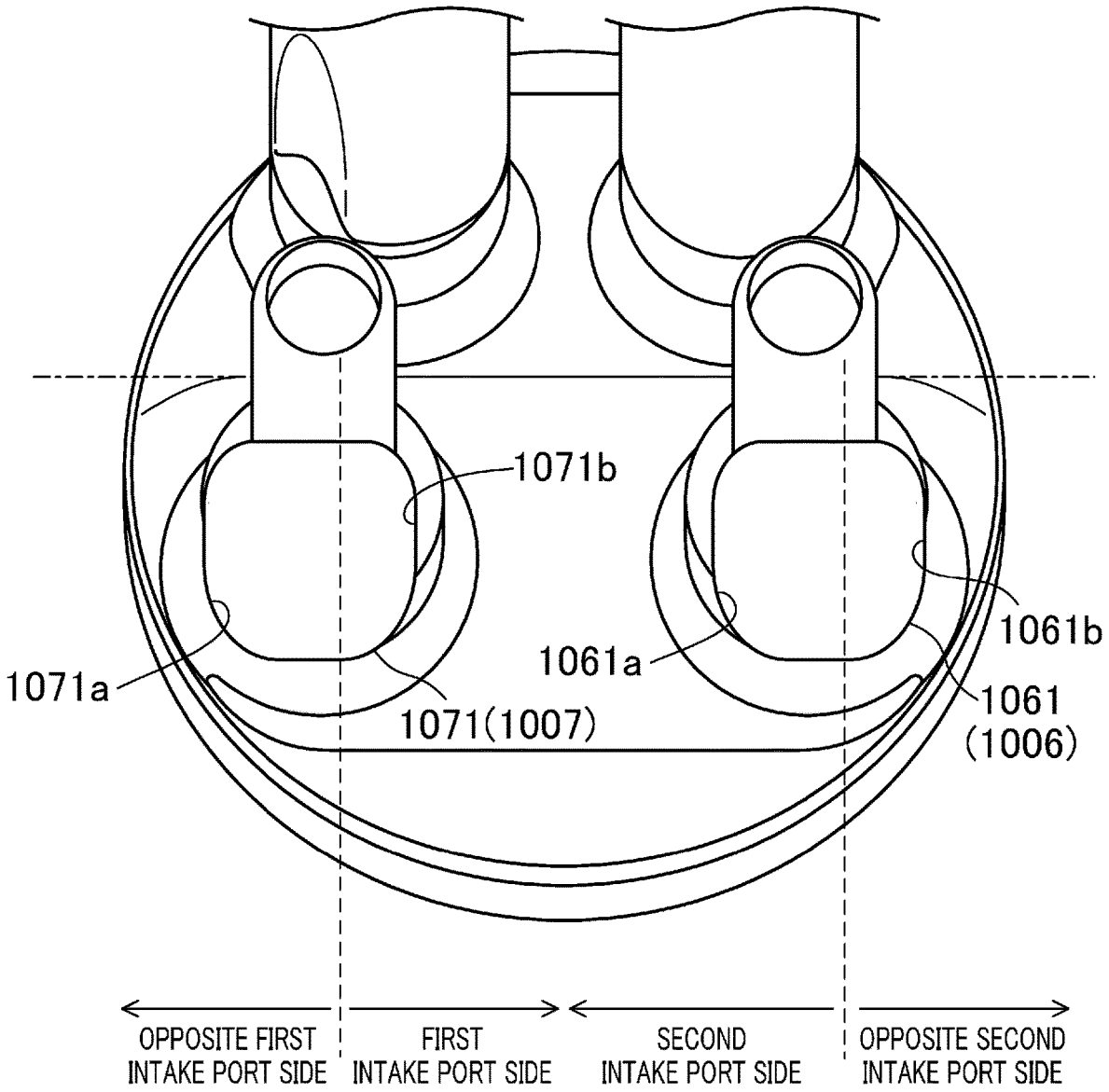
FIG. 10 is a view of an intake port structure of a comparative example, FIG. 10 corresponding to FIG. 9.
Figure 11:
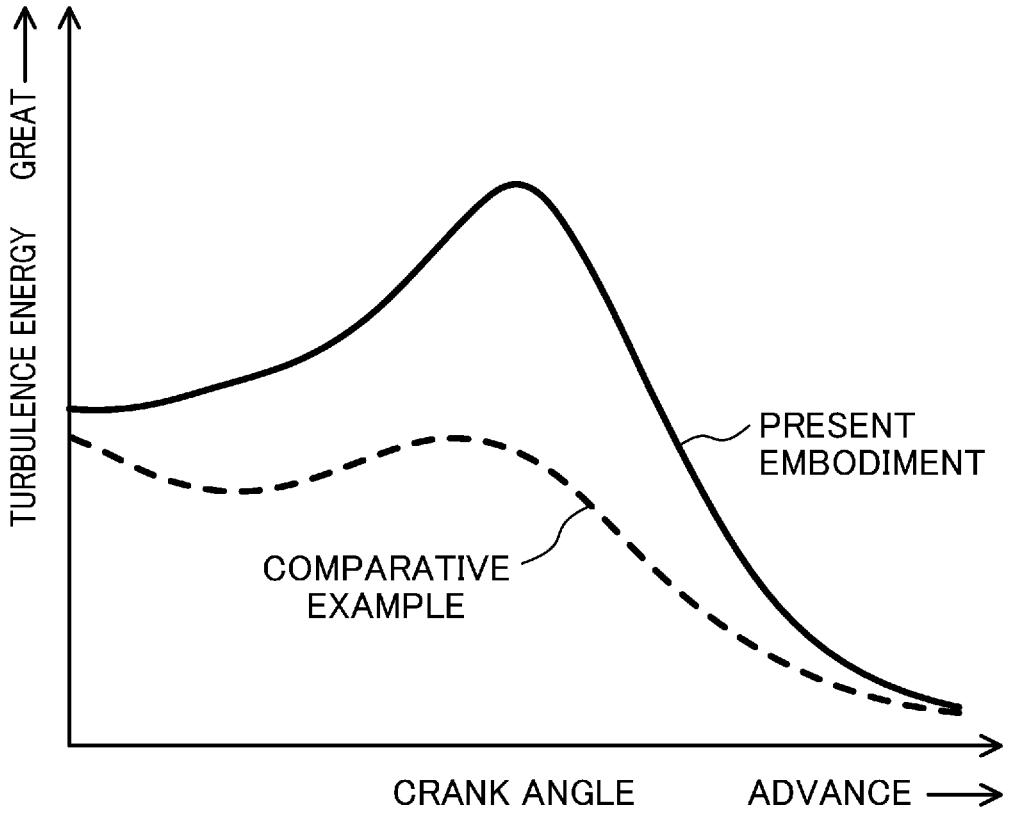
FIG. 11 is a graph of comparison of turbulence energy right below an ignition plug between the case of implementing an intake port structure of the comparison example and the case of implementing an intake port structure of the present embodiment.

Hereinafter, the intake air flow formed in the combustion chamber 5 when the intake port structure of the internal combustion engine according to the present embodiment is implemented will be described. FIG. 10 is a view of an intake port structure of a comparative example, FIG. 10 corresponding to FIG. 9. The intake port structure illustrated in FIG. 10 is different from the intake port structure according to the present embodiment in that both of a first intake port 1006 and a second intake port 1007 are formed in a square tubular shape. Specifically, as in an inner wall surface 1061*b* of an opposite second intake port 1007 side portion, an inner wall surface 1061*a* of a second intake port 1007 side portion of the first intake port 1006 of the comparative example is formed in a semi-square tubular shape. The same applies to inner wall surfaces 1071*a*, 1071*b* of the second intake port 1007 of the comparative example. Moreover, FIG. 11 is a graph of comparison of turbulence energy right below an ignition plug between the case of implementing the intake port structure of the comparative example and the case of implementing the intake port structure according to the present embodiment.

As described above, the intake ports 6, 7 according to the present embodiment are in the tumble port shape. With this configuration, the tumble flow can be formed in the combustion chamber 5, and therefore, the intensity of turbulence of the intake air can be increased.

However, in a case where the ignition plug 22 is arranged between two intake ports 6, 7 as illustrated in FIG. 3, the distance Di between the intake ports 6, 7 is increased according to the dimensions of the ignition plug 22 as described above. In the case of, e.g., the typical intake ports 1006, 1007, intake air having flowed through the intake ports 1006, 1007 separately flows at positions apart in the engine output axis O direction without joining together in combination with formation of the tumble flow by such air. Thus, the intensity of turbulence right below the ignition plug is relatively weakened, and therefore, ignition performance might be degraded.

However, at the second intake port 7 according to the present embodiment, the opposite first intake port side inner wall surface 71*a* formed as described above is provided. Thus, part of intake air passing through the second intake port 7 is, along the inner wall surface 71*a*, guided to the first intake port 6 side in the engine output axis O direction. The ignition plug 22 is arranged on the first intake port 6 side with respect to the second intake port 7. Thus, when the intake air guided by the opposite first intake port side inner wall surface 71*a* flows into the combustion chamber 5, the air flows in the vicinity of the electrode (i.e., an ignition unit) at a tip end of the ignition plug 22. Thus, as illustrated in FIG. 11, a sufficient intensity of turbulence can be ensured right below the ignition plug 22, and therefore, air-fuel mixture ignition performance can be ensured.

Moreover, the opposite first intake port side inner wall surface 71*a* is formed such that the extension L2 extending from the inner wall surface 71*a* crosses the center line LC. Thus, intake air passing through the second intake port 7 is guided inward of the combustion chamber 5. Thus, there is an advantage in ensuring of a sufficient intensity of turbulence right below the ignition plug 22.

Meanwhile, at the first intake port 6, the second intake port side inner wall surface 61*a* formed as described above is provided. Part of intake air passing through the first intake port 6 is, along the inner wall surface 71*a*, guided to the opposite second intake port 7 side in the engine output axis O direction. When the intake air guided as described above flows into the combustion chamber 5, such air flows apart from intake air having flowed in through the second intake port 7 in the engine output axis O direction. This prevents the flow of intake air having flowed in through the first intake port 6 from interfering with the flow of intake air having flowed in through the second intake port 7. This is effective in ensuring of a sufficient intensity of turbulence right below the ignition plug 22.

Moreover, the fuel injection valve 21 is arranged at the center portion of the ceiling surface 51, and therefore, intake air having flowed in through the second intake port 7 flows in the vicinity of the fuel injection valve 21. Fuel is injected to such a main flow, and therefore, there is an advantage in formation of a homogeneous air-fuel mixture in the vicinity of the ignition plug 22.

Further, the intake ports 6, 7 are both in the tumble port shape. The intake port structure according to the present embodiment is particularly effective for the tumble port shape on such a point that a sufficient intensity of turbulence can be ensured right below the ignition plug 22.

Other Embodiments

The above-described configuration may have the following configurations.

The above-described configuration is merely one example, and the present invention is not limited to such an embodiment. For example, in the above-described embodiment, the structure of the second intake port side inner wall surface 61*a* is designed creatively at the first intake port 6, but such a structure is not essential. As in the opposite second intake port side inner wall surface 61*b*, the second intake port side inner wall surface 61*a* may be in a semi-square tubular shape.

Moreover, the opposite first intake port side inner wall surface 71*a* is formed at the gently-curved surface at the second intake port 7, but the present invention is not limited to such a configuration. The opposite first intake port side inner wall surface 71*a* may be formed as a flat surface inclined with respect to the intake-exhaust direction.

DESCRIPTION OF REFERENCE CHARACTERS

1 engine (internal combustion engine)
2 cylinder
5 combustion chamber
51 ceiling surface
511 first intake opening (intake opening)
512 second intake opening (intake opening)
6 first intake port
61 downstream end portion of first intake port
61*a* inner wall surface of second intake port side portion
61*b* inner wall surface of opposite second intake port side portion
7 second intake port
71 downstream end portion of second intake port
71*a* inner wall surface of opposite first intake port side portion
71*b* inner wall surface of first intake port side portion
13 cylinder head
131 intake side inclined surface
132 exhaust side inclined surface
16 first valve (intake valve)
161 valve stem (shaft portion)
162 valve head (shade portion)
162*a* shade back
17 second valve (intake valve)
171 valve stem (shaft portion) p 172 valve head (shade portion)
172*a* shade back
21 fuel injection valve
22 ignition plug
C cylinder axis
O engine output axis

The invention claimed is:

1. An internal combustion engine intake port structure comprising:

a cylinder forming a combustion chamber;

two intake openings opening at a ceiling surface of the combustion chamber and arranged next to each other in an engine output axis direction on one side with respect to an engine output axis when the combustion chamber is viewed in a cylinder axis direction;

a first intake port connected to one of the two intake openings;

a second intake port connected to the other one of the two intake openings and arranged next to the first intake port in the engine output axis direction;

intake valves each provided at the first intake port and the second intake port and configured to open or close the intake openings at substantially identical timing; and an ignition plug arranged to face an inside of the combustion chamber and configured to ignite an air-fuel mixture in the combustion chamber, wherein the ignition plug is an internal combustion engine intake port structure arranged between the first intake port and the second intake port, and in a case where a downstream end portion of the second intake port is divided into a first intake port side and an opposite first intake port side in the engine output axis direction, an inner wall surface of a first intake port side portion extends, as viewed in a section perpendicular to a cylinder axis, substantially perpendicularly to the engine output axis as extending from an upstream side to a downstream side of the second intake port, and an inner wall surface of an opposite first intake port side portion extends in a direction toward the first intake port as extending from the upstream side to the downstream side of the second intake port.

2. The internal combustion engine intake port structure according to claim 1, wherein as viewed in the section perpendicular to the cylinder axis, the inner wall surface of the opposite first intake port side portion of the second intake port is formed such that an extension extending in a gas flow direction along the inner wall surface crosses a center line passing perpendicularly to the engine output axis through the ignition plug.

3. The internal combustion engine intake port structure according to claim 1, wherein in a case where a downstream end portion of the first intake port is divided into a second intake port side and an opposite second intake port side in the engine output axis direction, an inner wall surface of an opposite second intake port side portion extends, as viewed in the section perpendicular to the cylinder axis, substantially perpendicularly to the engine output axis as extending from an upstream side to a downstream side of the first intake port, and an inner wall surface of a second intake port side portion extends in a direction apart from the second intake port as extending from the upstream side to the downstream side of the first intake port.

4. The internal combustion engine intake port structure according to claim 1, wherein an internal combustion engine includes a fuel injection valve configured to supply fuel into the combustion chamber, and the fuel injection valve is, at the ceiling surface of the combustion chamber, arranged next to the ignition plug in a direction perpendicular to the engine output axis.

5. The internal combustion engine intake port structure according to claim 1, wherein the internal combustion engine includes an intake valve provided at each of the first intake port and the second intake port and configured to open or close the intake opening, the intake valve includes a shaft portion reciprocating up and down, and a shade portion connected to a lower end portion of the shaft portion and configured to contact the intake opening from an inside of the combustion chamber to close the intake opening, and when a corresponding one of the intake valves opens the intake opening, each of the downstream end portion of the first intake port and the downstream end portion of the second intake port extends, as viewed in a section perpendicular to the engine output axis, to direct to between a shade back of a portion of the shade portion positioned on a cylinder axis side with respect to the shaft portion and the ceiling surface facing the shade back.

* * * * *